US009532672B2

(12) United States Patent
Sandgrund

(10) Patent No.: US 9,532,672 B2
(45) Date of Patent: Jan. 3, 2017

(54) ADJUSTABLE STORAGE SYSTEM FOR CLOTHING

(71) Applicant: David Sandgrund, New York, NY (US)

(72) Inventor: David Sandgrund, New York, NY (US)

( * ) Notice: Subject to any disclaimer, the term of this patent is extended or adjusted under 35 U.S.C. 154(b) by 122 days.

(21) Appl. No.: 14/064,857

(22) Filed: Oct. 28, 2013

(65) Prior Publication Data

US 2014/0284291 A1 Sep. 25, 2014

Related U.S. Application Data

(60) Provisional application No. 61/804,839, filed on Mar. 25, 2013.

(51) Int. Cl.
*A47G 25/06* (2006.01)
*A47F 5/00* (2006.01)
*A47F 7/16* (2006.01)

(52) U.S. Cl.
CPC ..... *A47G 25/06* (2013.01); *A47F 5/0043* (2013.01); *A47F 7/16* (2013.01); *Y10T 29/49826* (2015.01)

(58) Field of Classification Search
CPC ..... A47G 25/06; A47G 25/0664; A47F 7/16; A47F 7/163; A47F 7/18; A47F 7/19; A47F 7/22; A47F 7/24; A47F 5/0043
USPC ..... 211/85.11, 85.3
See application file for complete search history.

(56) References Cited

U.S. PATENT DOCUMENTS 378,201 A 2/1888 Jacoby
381,776 A * 4/1888 Harbison ..... A47F 5/103 211/106.01
1,446,036 A 2/1923 Dodd
1,464,904 A * 8/1923 Feldman ..... A47G 25/0664 182/181.1
1,554,137 A 9/1925 Slifkin
2,760,746 A * 8/1956 Botolfsen ..... B68C 1/002 211/85.11
2,809,755 A * 10/1957 Martorello ..... B60P 3/04 211/162
2,937,759 A 5/1960 Smith
D257,195 S 10/1980 Swett et al.
4,541,535 A * 9/1985 Bartholomew ..... B68C 1/002 211/85.11
D289,353 S 4/1987 Davis et al.
(Continued)

FOREIGN PATENT DOCUMENTS

FR 616 335 A 1/1927
FR 2 182 318 A5 12/1973

OTHER PUBLICATIONS

International Searching Authority (PCT), International Search Report, Sep. 19, 2014.

(Continued)

*Primary Examiner* — Stanton L Krycinski
(74) *Attorney, Agent, or Firm* — Ladas & Parry LLP

(57) ABSTRACT

A system for storing unfolded garments, such as shirts and sweaters, on multiple shelves. The shelves may be curved from side to side and raised in the middle. The shelves may be placed at intermittent variable points along a vertical support member which attaches to a wall or to a base. The multiple shelves attach to brackets which extend from the vertical support member at vertically spaced points along the length of the vertical support member. The system permits the shelves to slide out from the vertical support member for convenient access.

15 Claims, 17 Drawing Sheets

(56) References Cited

U.S. PATENT DOCUMENTS

| | | | | |
|---|---|---|---|---|
| D301,407 | S | 6/1989 | Boeri | |
| 5,050,744 | A | 9/1991 | Floyd | |
| D371,870 | S | 7/1996 | Sylvester | |
| D378,448 | S * | 3/1997 | Billings | D30/108 |
| 5,865,325 | A | 2/1999 | Comstock | |
| 6,189,706 | B1 | 2/2001 | Akins | |
| 6,206,207 | B1 * | 3/2001 | Kelley | B68C 1/002 211/85.11 |
| 6,591,996 | B1 | 7/2003 | Wu | |
| 6,955,270 | B2 | 10/2005 | Lay et al. | |
| 7,255,235 | B1 * | 8/2007 | Vry | B68C 1/002 211/85.11 |
| 7,500,573 | B1 * | 3/2009 | Flynn | B68B 9/00 211/85.11 |
| 7,874,436 | B2 * | 1/2011 | Hought | A47B 81/00 211/1.51 |
| 7,942,277 | B1 * | 5/2011 | Flynn | B68C 1/002 211/1.53 |
| 8,141,720 | B2 | 3/2012 | Kellogg et al. | |
| 8,616,383 | B1 * | 12/2013 | Miller | B68C 1/002 211/1.51 |
| 2002/0134742 | A1 | 9/2002 | Huang | |
| 2004/0182803 | A1 * | 9/2004 | Lay | A47B 46/00 211/85.11 |
| 2007/0241072 | A1 | 10/2007 | Bryant et al. | |
| 2008/0121146 | A1 | 5/2008 | Burns et al. | |

OTHER PUBLICATIONS

International Searching Authority (PCT), Written Opinion of the International Searching Authority, Sep. 19, 2014.

* cited by examiner

ADJUSTABLE STORAGE SYSTEM FOR CLOTHING

CROSS REFERENCE TO RELATED APPLICATIONS

This application claims priority from U.S. Provisional Application No. 61/804,839 filed on Mar. 25, 2013.

FIELD OF THE INVENTION

The present invention generally relates to a clothing storage system and more particularly to a clothing storage system which reduces or eliminates unwanted creases in garments and the need to fold these garments.

BACKGROUND OF THE INVENTION

Typically, garments such as shirts and sweaters are folded and stored in dresser drawers, or on closet shelves or hung on hangers in closets. These methods of storage are subject to several disadvantages, or the garments may remain unfolded, strewn about a room until being ironed or worn.

Unless a folding board is used, it is extremely difficult to have all the garments folded the same size making closets and drawers unsightly and an inefficient use of the space. The folded garments are generally bulky, resulting in a need for a significant amount of dresser drawer or closet shelving space to store a relatively small quantity of garments. Furthermore, folding clothes takes time and requires a dedicated space.

Also, when garments are folded for storage unwanted creases are usually formed in the folded garment.

An alternative to folding is to hang the garments on clothes hangers. When garments such as sweaters or t-shirts are hung on clothes hangers for storage the weight of the garment in combination with the relatively narrow configuration of typical hangers results in the formation of unwanted bulges in the shoulders of the garments. In an effort to overcome this problem, users often resort to special clothes hangers of increased width to reduce contact stress between the clothes and the hangers. This is usually ineffective since it results in hangers which require excessive space in closets and costs more.

Additional attempts to provide effective storage for clothing include the devices shown in the following U.S. patents:

U.S. Pat. No. 2,017,944 to Braley is directed to a garment support provided with a plurality of plates affixed to an upstanding post. A number of garments can be suspended from each of the plates. Spring straps are used to secure the garments to the plate. The spring straps bear on the garments in order to secure them on the device. This presents the potential to mark, tear or otherwise distort the garment.

U.S. Patent Application Publication No. 2010/0193455 to Russell et al. discusses a wall mounted furniture system provided with a plurality of shelves and a vertical column. The Russell et al. device provides thin flat shelves having sharp edges. This system has the drawback of tendency to stretch or distort garments placed thereon.

U.S. Pat. No. 711,690 to Zimmer illustrates a display stand provided with a number of concave slotted tubes affixed to the display stand. A fibrous filling extends from holes in the tubes to secure items, such as combs to the tubes. The Zimmer device stores garments by hanging them on tubes which have the same disadvantages as conventional hangers.

U.S. Pat. No. 6,591,996 to Wu shows a shelving system provided with a plurality of shelves attached to a vertical column. The Wu device provides thin, flat shelves which tend to stretch or distort garments stored thereon in the same disadvantageous manner as the Russell et al device.

Despite the developments in the prior art there remains a need for an adjustable storage system for clothing.

SUMMARY OF THE INVENTION

The foregoing and other problems and deficiencies in known garment storage systems are solved and a technical advantage is achieved by an adjustable storage system for clothing. That is, the structure of an adjustable storage system for clothing comprises a support member, a plurality support brackets adjustably connected to the support member, a plurality of shelves, with each of the shelves disposed in a generally horizontal orientation and mounted respectfully on one of each of the plurality of support brackets. Each shelf comprises a surface having a central portion and flanking wing portions and the central portion is raised relative to the flanking wing portions. In a further embodiment, the support member comprises a vertical support member. Each shelf may further comprise a frame portion having rounded edges, and the surface has a plurality of apertures.

In a further embodiment, the central portion and the flanking wing portions of the shelves of the adjustable storage system for clothing are curved in a convex shape, and the convex central portion leads to the pair of convex flanking wing portions. The curve of the central portion has a greater radius than the curve of said flanking wing portions.

In yet a further embodiment of the adjustable storage system for clothing, each of the shelves further comprises a pair of end portions with the flanking wing portions leading, one each, to the end portion and with the end portions generally vertically disposed.

In still a further embodiment, the shelves are each slideably mounted on a respective one of the plurality of brackets.

In another embodiment of the adjustable storage system for clothing the shelves include friction material with the friction material disposed on an upper surface of each of shelf. The friction material is centrally disposed on the surface of each of the shelves.

In a further embodiment, each shelf has a generally rectangular configuration.

In still a further embodiment, each shelf of the adjustable storage system for clothing comprises sides, wherein each shelf is curved side to side. Specifically, the surface of each shelf is convex shaped.

In a further embodiment, an adjustable storage system for clothing comprises a support member, a plurality support brackets adjustably connected to the support member, and a plurality of shelves, with each of the shelves are disposed in a generally horizontal orientation and mounted respectfully on one of each of the plurality of support brackets. Each of the shelves comprise a surface having a central portion and flanking wing portions and with the central portion raised relative to the flanking wing portions. The central portion and the flanking wing portions of the shelves are curved in a convex shape, and each of the plurality of shelves are horizontally adjustable capable of being slid away from the support member.

In a further embodiment, a method for storing garments which reduces the formation of creases and wrinkles in the garment comprises the steps of securing a support member to a vertical surface, attaching a plurality support brackets, wherein the plurality of support brackets are adjustably attached to the support member, mounting a plurality of shelves, wherein each shelf of the plurality of shelves is mounted on one support bracket of the plurality of support and is disposed in a generally horizontal orientation. Each of the shelves comprises a surface having a central portion and flanking wing portions and with the central portion raised relative to the flanking wing portions, and the central portion and the flanking wing portions of the shelves are curved in an elliptical convex shape. Each of the plurality of shelves are horizontally adjustable capable of being slid away from the support member.

In still a further embodiment, is a shelf assembly for removably attaching to a horizontal support bracket mounted on a support member. The shelf assembly includes a surface, a channel, friction material, and one or more attaching mechanisms. The surface is formed by two separate matching halves and is secured to the channel by the one or more attaching mechanisms. The friction material is secured over the attaching mechanisms. Each of the two separate matching halves has a central portion, flanking wing portions and end portions, and when the two separate matching halves are attached, they form an elliptical arc, where the central portion is raised relative to said flanking wing portions.

BRIEF DESCRIPTION OF THE DRAWINGS

The foregoing summary, as well as the following detailed description of the invention will be better understood when read in conjunction with the appended drawings. For the purpose of illustrating the invention, there are shown in the drawing embodiments which are presently preferred. It should be understood, however, that the invention can be embodied in different forms and thus should not be construed as being limited to the embodiments set forth herein.

DETAILED DESCRIPTION

The present subject matter will now be described more fully hereinafter with reference to the accompanying figures, in which representative embodiments are shown. The present subject matter can, however, be embodied in different forms and should not be construed as limited to the embodiments set forth herein. Rather, these embodiments are provided to describe and enable one of skill in the art. Unless otherwise defined, all technical and scientific terms used herein have the same meaning as commonly understood by one of ordinary skill in the art to which the subject matter pertains. All publications, patent applications, patents, and other references mentioned herein are incorporated by reference in their entirety.

While reference herein is made to storage of shirts, sweatshirts, and sweaters, it is to be understood that the present invention has application to any garment such as pants and skirts.

Figure 1:
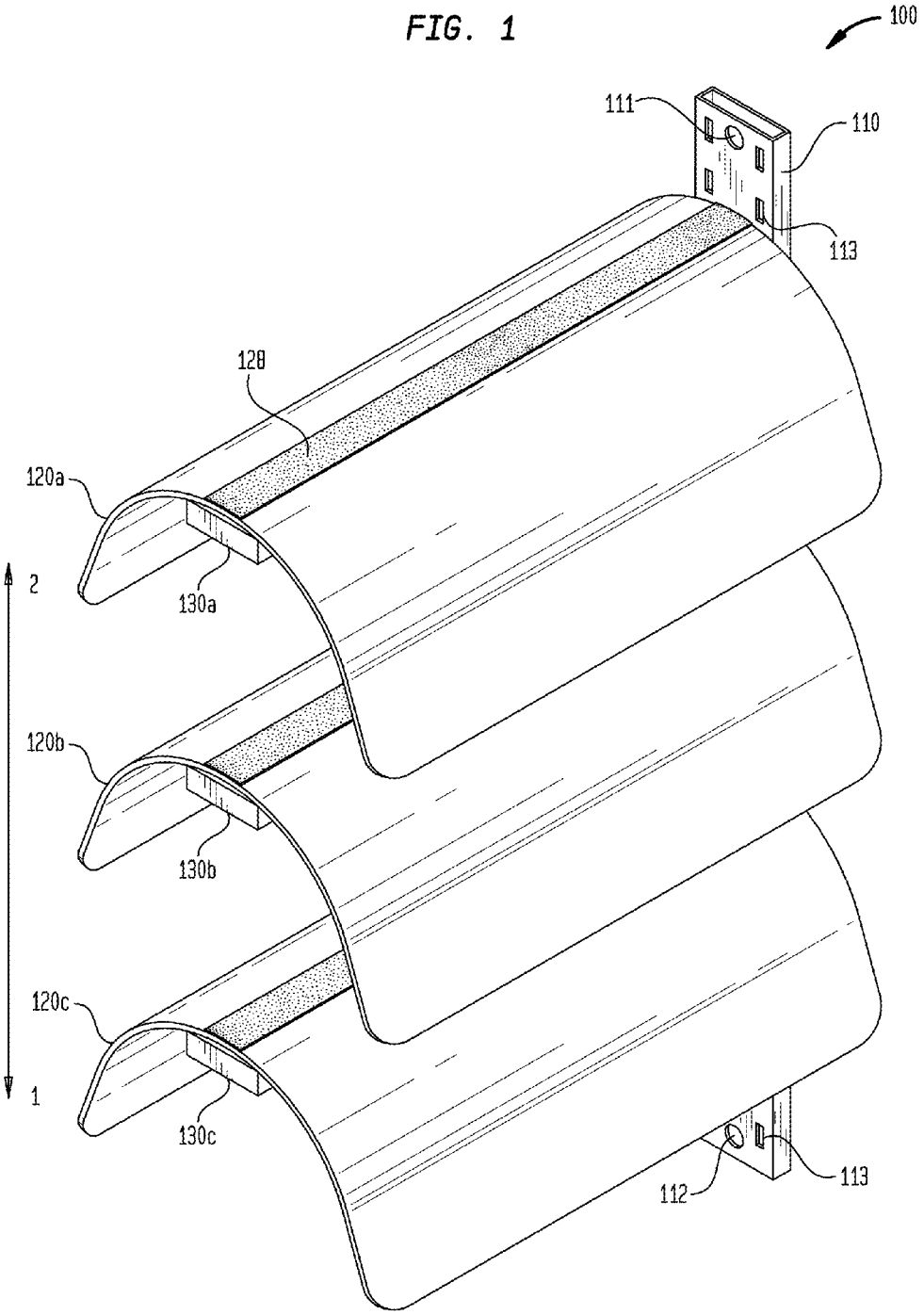
FIG. 1 is an overall perspective view of an embodiment of the adjustable storage system for clothing.

FIGS. 1, 11, 14-18 depict various embodiments of the present invention of an adjustable storage system for clothing 100. The adjustable storage system for clothing 100 includes a support member 110, a plurality of adjustable shelf assemblies 120*a-c*, and horizontal support brackets 130*a-c*. Depicted in FIG. 1 is an adjustable storage system for clothing 100 with three adjustable shelf assemblies 120*a-c*. It is contemplated that more or less shelf assemblies may be attached to the support member 110. FIG. 1 depicts the support member 110 in a vertical configuration. However, it is also contemplated that the support member may be mounted in a horizontal orientation with the adjustable shelf assemblies spaced apart from each other in a horizontal plane, embodiment 700 (see FIG. 19).

The support member 110 may be comprised of a single piece structure or support rail of a predetermined length. It is envisioned that the single piece structure may be provided in varying predetermined lengths, ranging from two (2) feet to nine (9) feet. Longer support members are contemplated.

Figure 2:
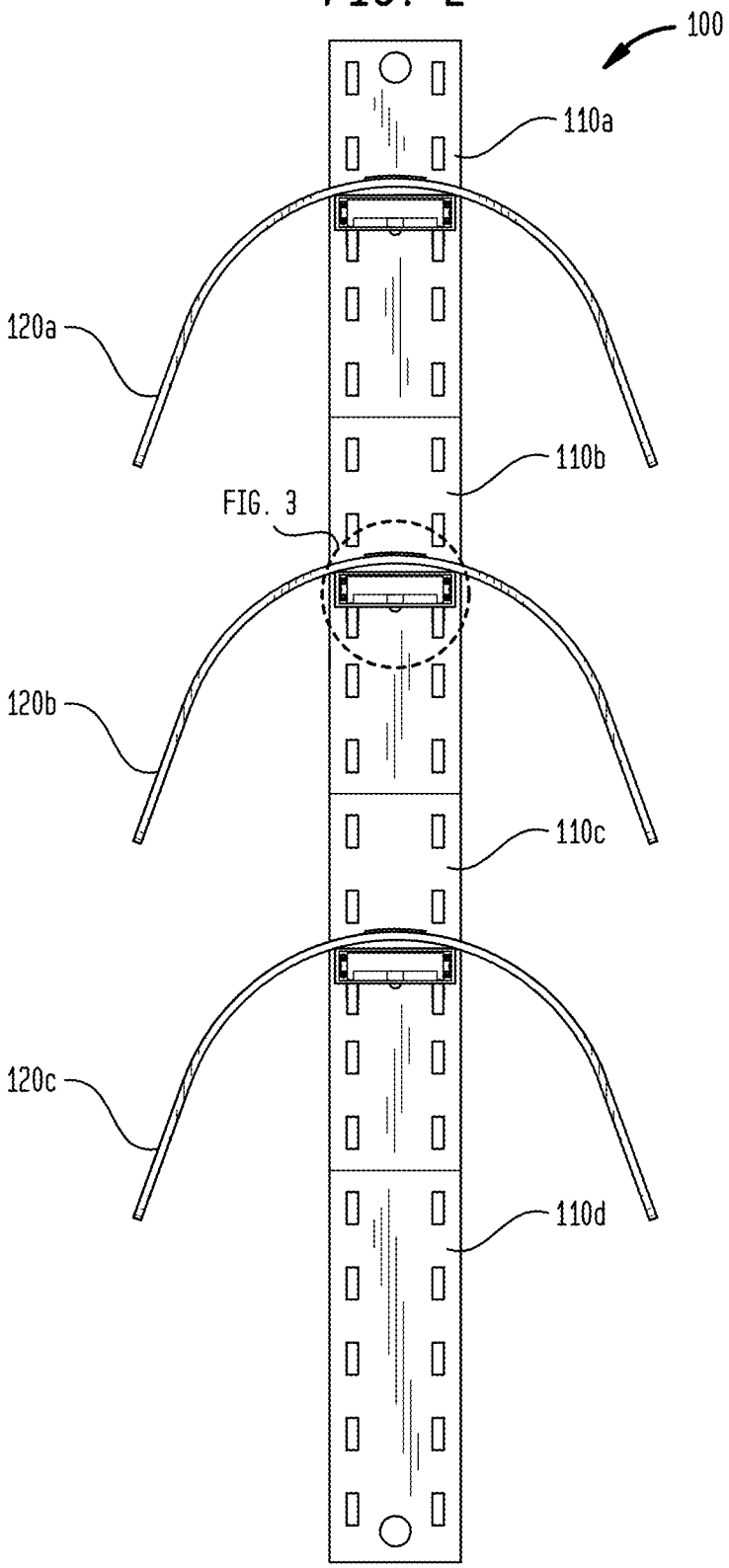
FIG. 2 is a front elevational view of the embodiment shown in FIG. 1.
Figure 4:
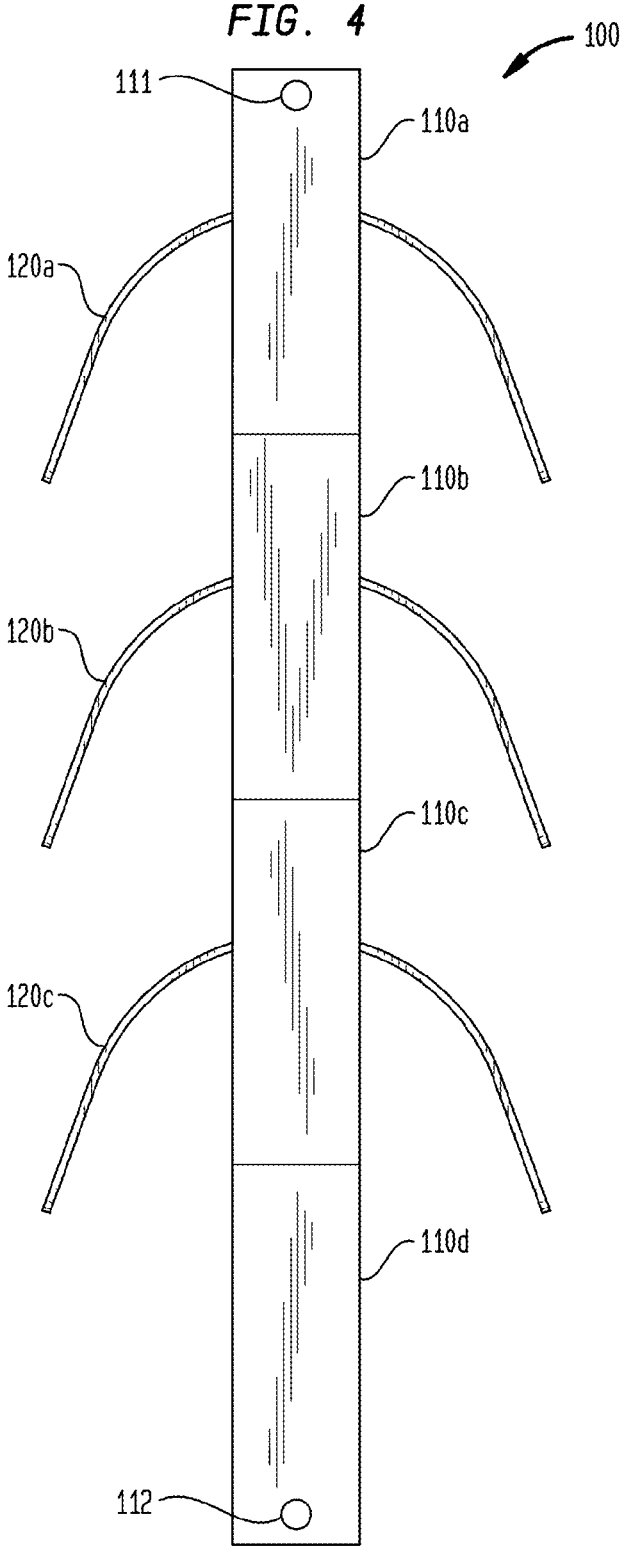
FIG. 4 is a back elevational view of a shelf according to the embodiment shown in FIG. 1.

It is also contemplated that the support member 110 may be in the form of sectional units, as shown in FIGS. 2 and 4, comprising multiple segments or support rails 110*a-d* such that the length of the support member 110 is adjustable. The sections may come apart and are interchangeable so that any number of sections may be connected for any preferred length. The length of the adjustable support member may be expandable from 2 feet to 9 feet or longer. A pin locking mechanism (not shown) may be used to secure the number of sections together. One end of each section 110*a-d* includes the pin locking mechanism (not shown) comprising of a pin, a spring (not shown) and body (not shown). The other end of each section may include several holes spaced along the length of the section. The dimension of the pin and holes are such that pin is able to fit in the holes. In such a system, the diameter or cross-section of each section is such that the end with the pin is smaller than the end with the holes, such that "pin-end" of a section can slide within the "hole-end" of another section. When the pin coincides with a hole, the pin is extended by the spring through the hole, locking the two sections together. The length of the support member 110 may be adjusted depending on which hole the pin of the pin locking mechanism snaps into and how many sections are employed.

Alternative commercially available mechanisms for attaching multiple segments of the support member 110 together are contemplated. One such method includes sleeves (not shown) that fit over the ends of two adjacent sections/segments and are secured by one or more tensioning screws (not shown). Alternatively, multiple adjacent segments of the support member may be installed adjacent to each other without the use of sleeves.

Alternatively, the multiple support rails 110*a-d* may be configured as an extendable or telescoping unit. Known telescoping designs may be used in the implementation of a telescoping support member 110. The telescoping unit may use pin locking mechanisms similar to that discussed above to adjust the length of the vertical support member to a desired length.

As shown in FIG. 1, the support member 110 may have a structural shape of a hollow rectangular channel, a Hollow Structural Section (HSS). The support member may also be a C-section or U-shaped structure. It is contemplated that alternative structural shapes may be used such as HSS—square, circular (pipe), and hexagon. The support member 110 includes a linear array of slots 113 along the length of the column. Where the support member 110 is in the form of an HSS, the linear array of slots 113 may be positioned on each side of the member 110 in the case of a rectangular/polygon configuration or along the diameter of the circular member 210 (see FIG. 11). The slots 113 may be used for attaching support brackets 130 to the support member or to attach the support member to a mounting surface.

The slots 113 of the support member are only one possible configuration for attaching support brackets 130 to the support member 110. It is also contemplated that the support member may include a channel along the length of the support member 110 such that when one end of the support bracket is inserted into the channel and rotated to a 90 degree angle with the support member 110, the sides of the channel act on the support bracket in a fractional manner holding the support bracket 130 in place. Other means besides the slots 113 and a channel are contemplated for attaching a support bracket 130 to the support member 110.

The support member 110 may be secured to a wall or a building stud either permanently or semi-permanently. The support member 110 may be secured using holes 111, 112 and conventional fasteners which have not been illustrated. Alternatively, mounting brackets (now shown) may be attached to a wall and the support member 110 may be attached to the mounting brackets using clips inserted through one or more of the slots 113. Other standard means of affixing the support member 110 to a wall or other structures such as a post are contemplated, such as sleeves affixed to a wall or some other mounting surface. It is also contemplated that the support member 110 may be affixed to furniture, such as an armoire, a portable closet or some other suitable piece of furniture. The support member 110 may be secured to the back wall on the inside cabinet of the armoire. Alternative placements on a piece of furniture are contemplated, such as on a door or on a side of the furniture.

Figure 11:
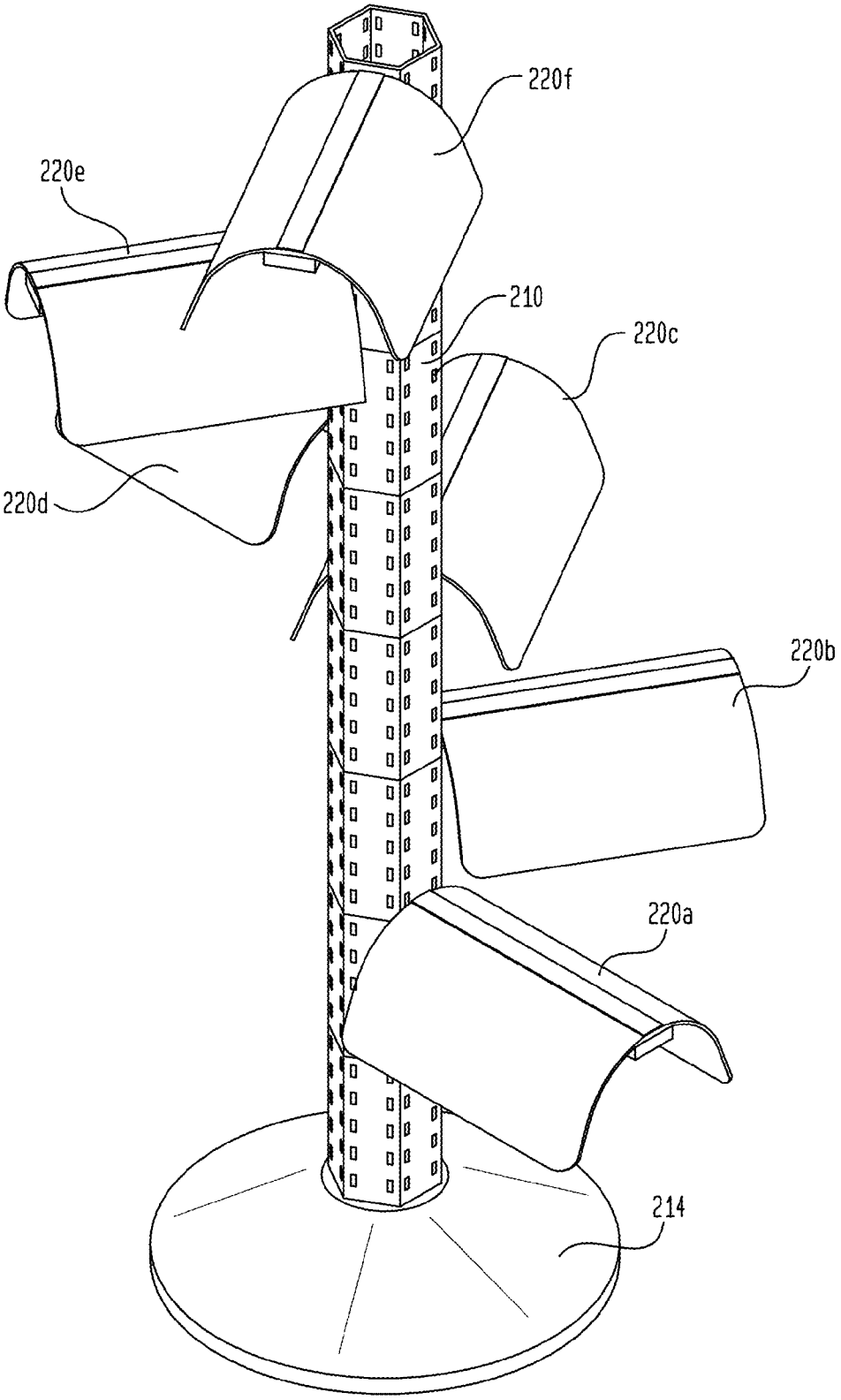
FIG. 11 is a perspective view of another embodiment of the invention.

Alternatively, the support member 210 may be mounted to a base 214 as shown in FIG. 11, depicting an alternative embodiment 200 of the invention. This alternative embodiment 200 provides a free-standing unit and eliminates the need to secure the support member 210 to a wall or any other structure. The support member 210 may be secured to the floor only or to the floor and ceiling to provide additional stability to the Adjustable Storage System. Where the support member has an HSS structure such as a hexagon 210, shelves 220*a-f* may be positioned on various sides of the hexagon forming, for example, a spiral effect allowing for more shelves to be added and maintain easy access to the garments on the various shelves (see FIG. 11).

Figure 19:
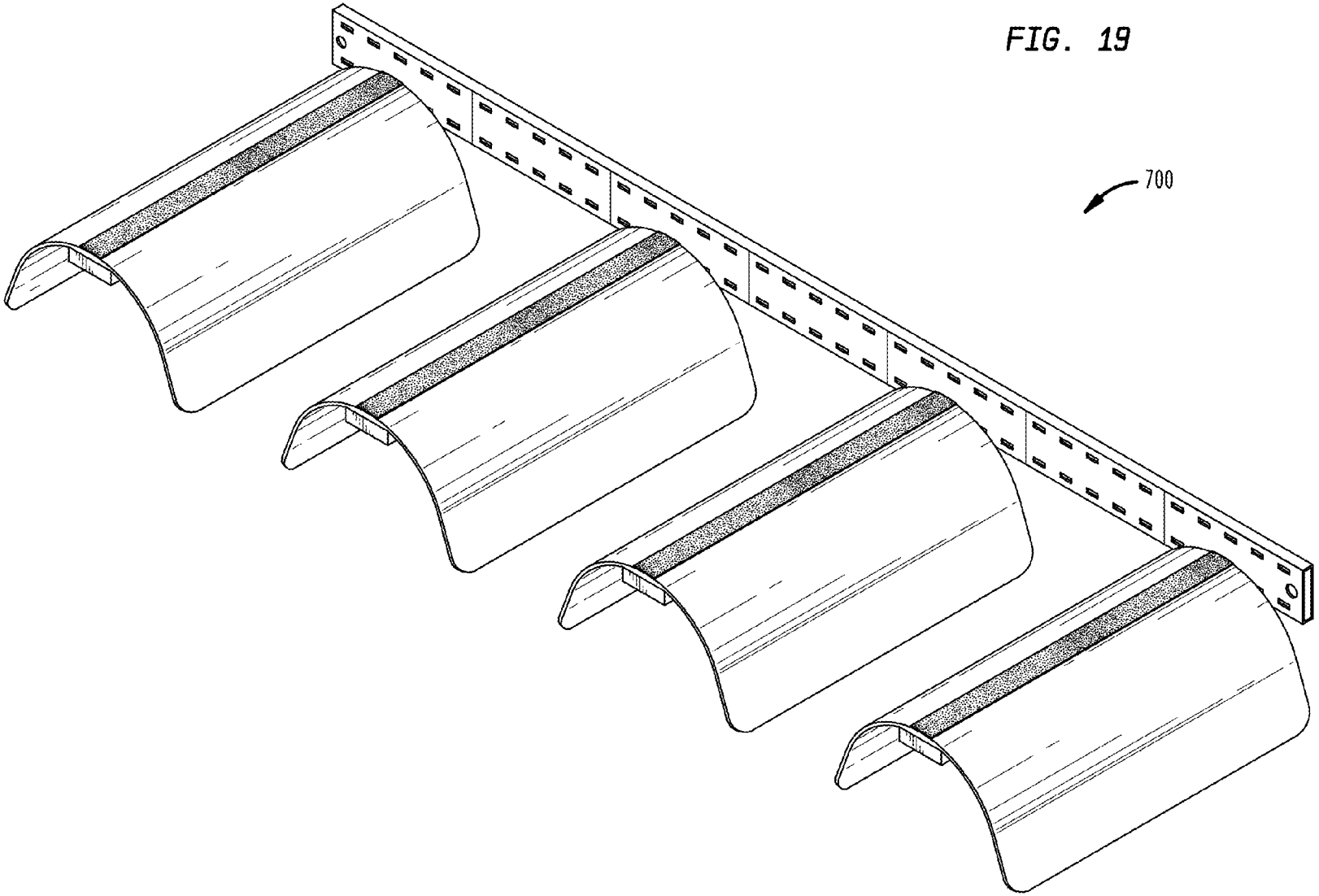
FIG. 19 is a perspective view of a Horizontal Configuration of an embodiment of the invention.

As shown in FIG. 1, the support member 110 is installed in a vertical orientation with the shelf assemblies positioned one above the other. It is also contemplated that the support member 110 may be installed in a horizontal orientation with the shelf assemblies positioned on the same horizontal plane, one next to the other as shown in FIG. 19. The distance between shelves in a horizontal orientation configuration may be as little as 4 or 5 inches, allowing garments to hang over the ends of the shelves without impacting the garments on the adjacent shelf(ves).

Shelf assemblies 120*a-c* are adjustably mounted on the support member 110 at intermittent and variable locations by support brackets 130. As mentioned previously, the figures depict an exemplary embodiment with three (3) shelf assemblies. It is contemplated that the invention may include more or less shelf assemblies, as preferred. The shelf assemblies are vertically adjustable along the length of the support member 110 as well as horizontally adjustable from the support member 110. Specifically, the shelf assemblies 120*a-c* may be extended away from the support member 110 along the length of the support bracket 130 in the direction of arrows 3, 4 shown in FIG. 10. The shelf assemblies 120*a-c* may be pulled away from the support member 110 via a traditional rail mechanism found on typical desk drawers. The rail mechanism may comprise matching horizontal rails (described below) along with complimentary ball bearing tracks (described below). Alternative mechanisms for extending the shelf assemblies are also contemplated.

Figure 3:
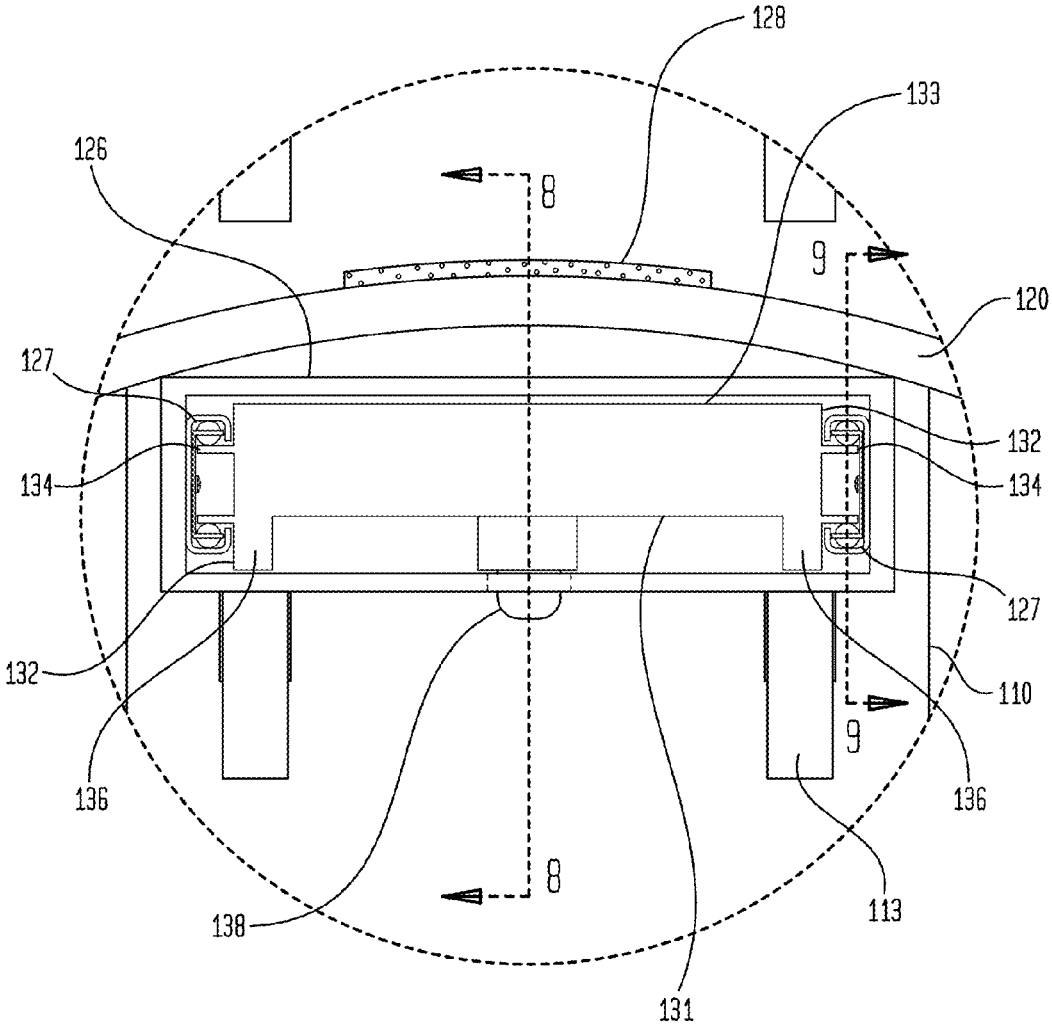
FIG. 3 is an exploded view of a shelf and support bracket shown in FIG. 2.
Figure 10:
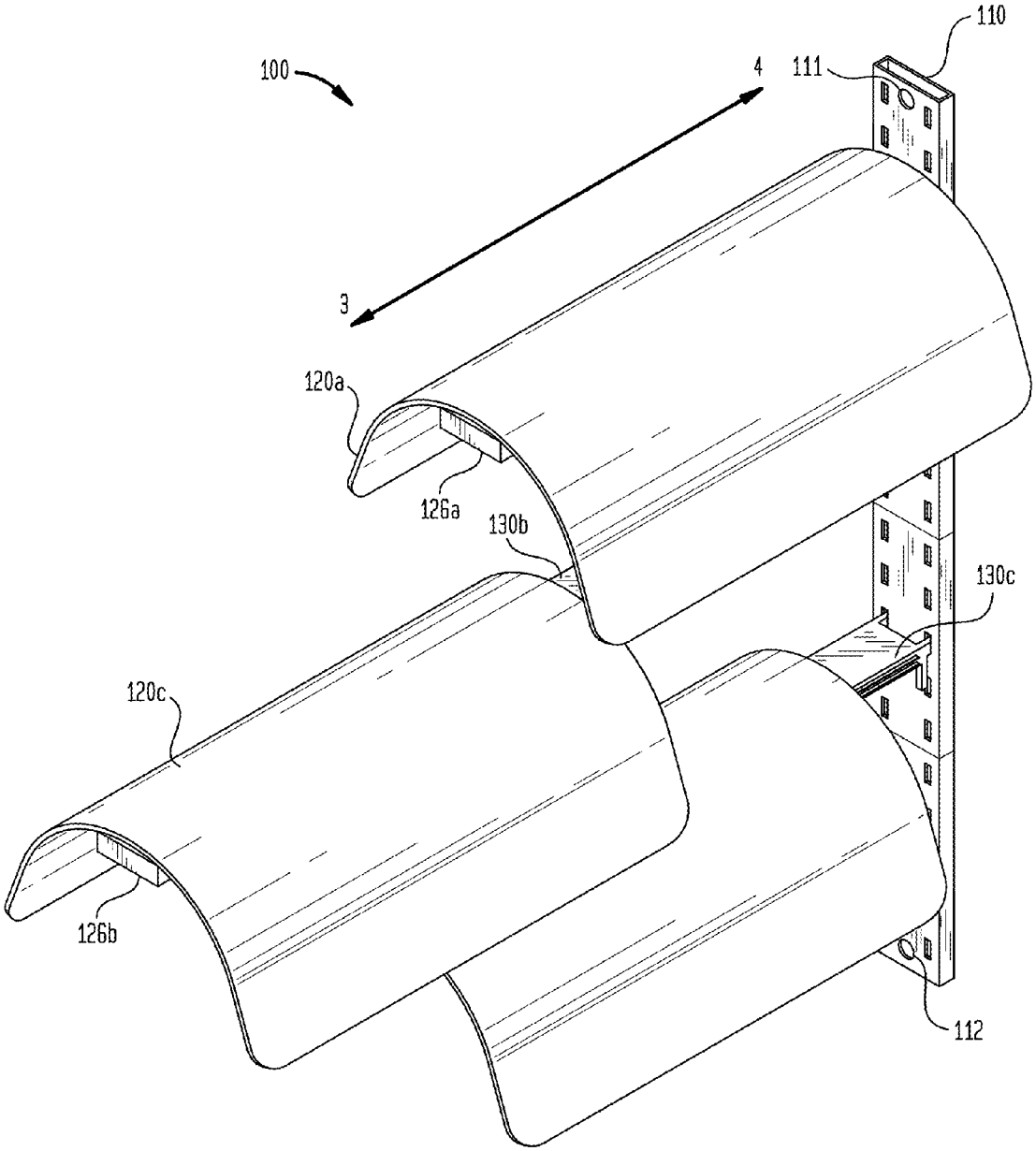
FIG. 10 is a perspective view with shelves extended of the embodiment shown in FIG. 1.

As shown in FIGS. 3 and 10, U-shaped support brackets 130 are adjustably mounted to the support member 110. The support brackets 130*a-c* may be comprised of alternative shapes, not only U-shaped. The number of support brackets 130*a-c* corresponds to the quantity of shelf assemblies 120*a-c* employed. The support brackets 130 have a length of between 12 and 28 inches, however, other sizes, larger and smaller, are contemplated. The support bracket 130 may include hook portions 139 at one end. The hook portions 139 are proportioned to removably fit Each support bracket 130 may include a flat top portion 133 and a pair of downwardly directed flange portions 136 shown in FIG. 3. On each of the side surfaces 132 of the support bracket 130 are a pair of horizontally projecting rails 134. Mounted on the underside surface 131 of the support bracket 130 is a pin locking mechanism 138. The pin locking mechanism 138 on the support bracket 130 together with the channel 126 (described below) function similar to the pin locking mechanism of the support member 110. The pin locking mechanism 138 of the support bracket 130 limits the distance a shelf assembly can be extended from the support bracket 130.

Figure 13:
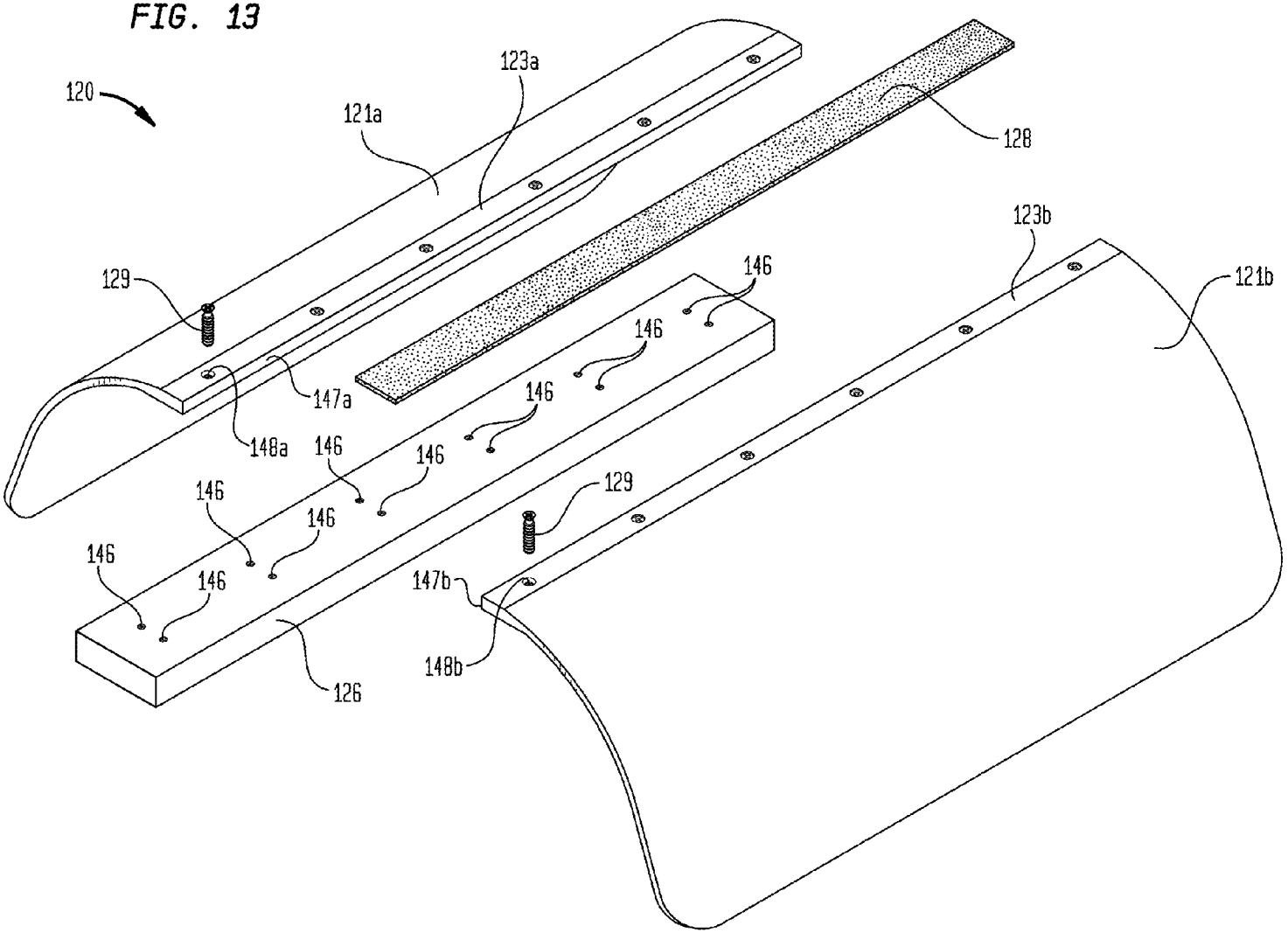
FIG. 13 is an exploded view of a shelf assembly embodiment.
Figure 14:
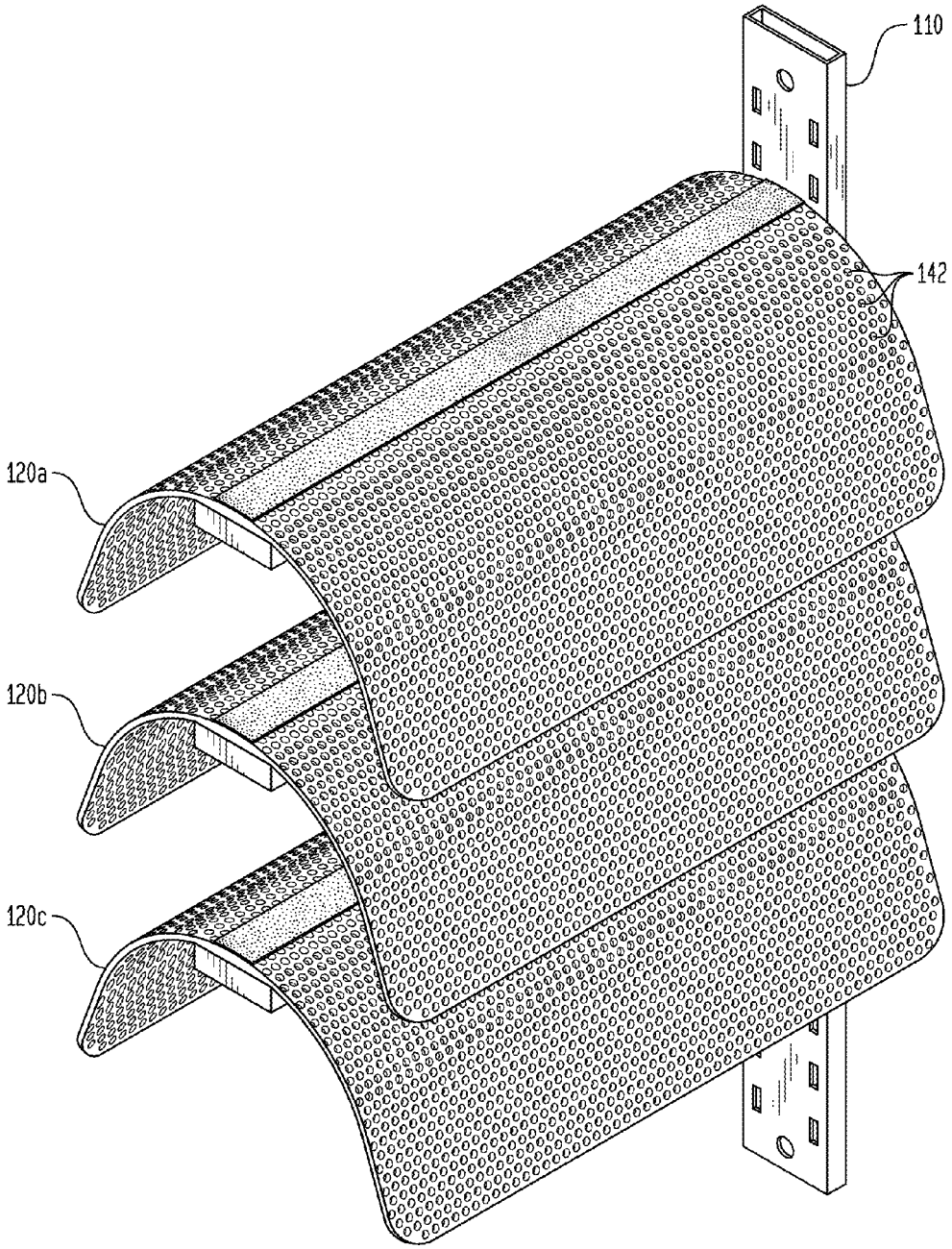
FIG. 14 is a perspective view of an embodiment of the invention.

The details of the construction of the several shelf assemblies 120*a-c* are identical and therefore only the construction of the shelf assembly 120*a* will be described. The shelves may be of varying sizes and shapes. Shelf assembly 120 may include a shelf 121, a support channel 126, friction material 128, a handle 140, and a frame 141. The shelf assembly may also be constructed as unitary structure or may be comprised of multiple parts for assembly as shown in FIG. 13.

Figure 6:
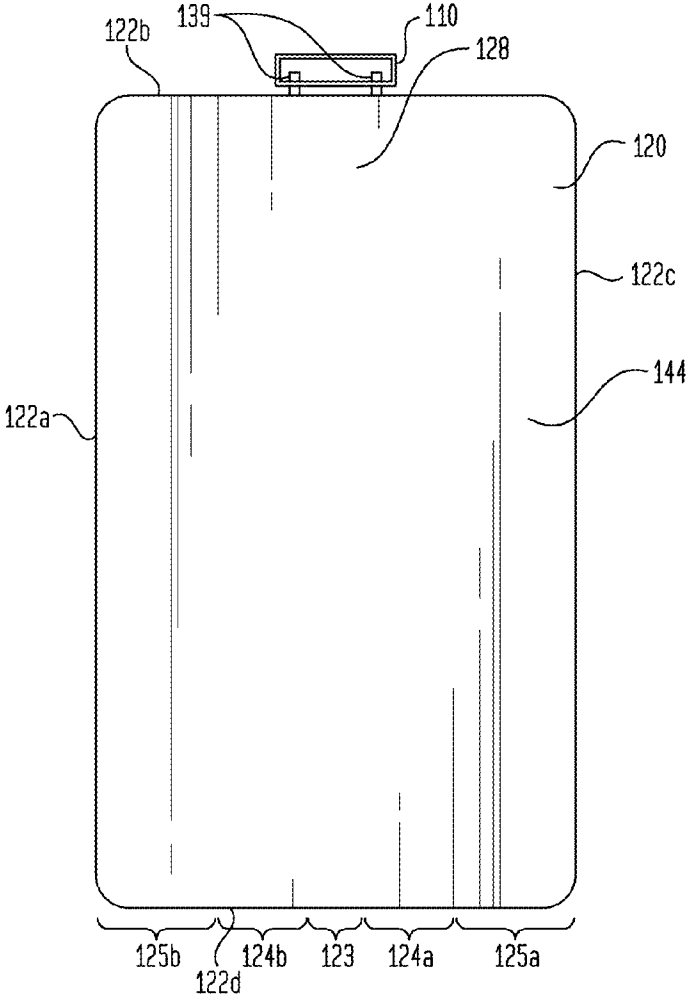
FIG. 6 is a top elevational view of the embodiment shown in FIG. 1.

The shelf 121, when viewed from above (see FIG. 6), has a generally rectangular shape with edges 122*a-d*, and include a central portion 123, flanking wing portions 124*a, b* and end portions 125*a, b*. The corners of the shelf 121 may be rounded to help prevent creasing or distortion of the shirt or garment 800 when draped over the shelf assembly 120. The edges 122*a-d* may be rounded, chamfered or beveled such that the fabric of a garment will not snag or get caught on an edge and to help prevent creasing or distortion of the shirt or garment 800 when draped over the shelf assembly 120.

Figure 5:
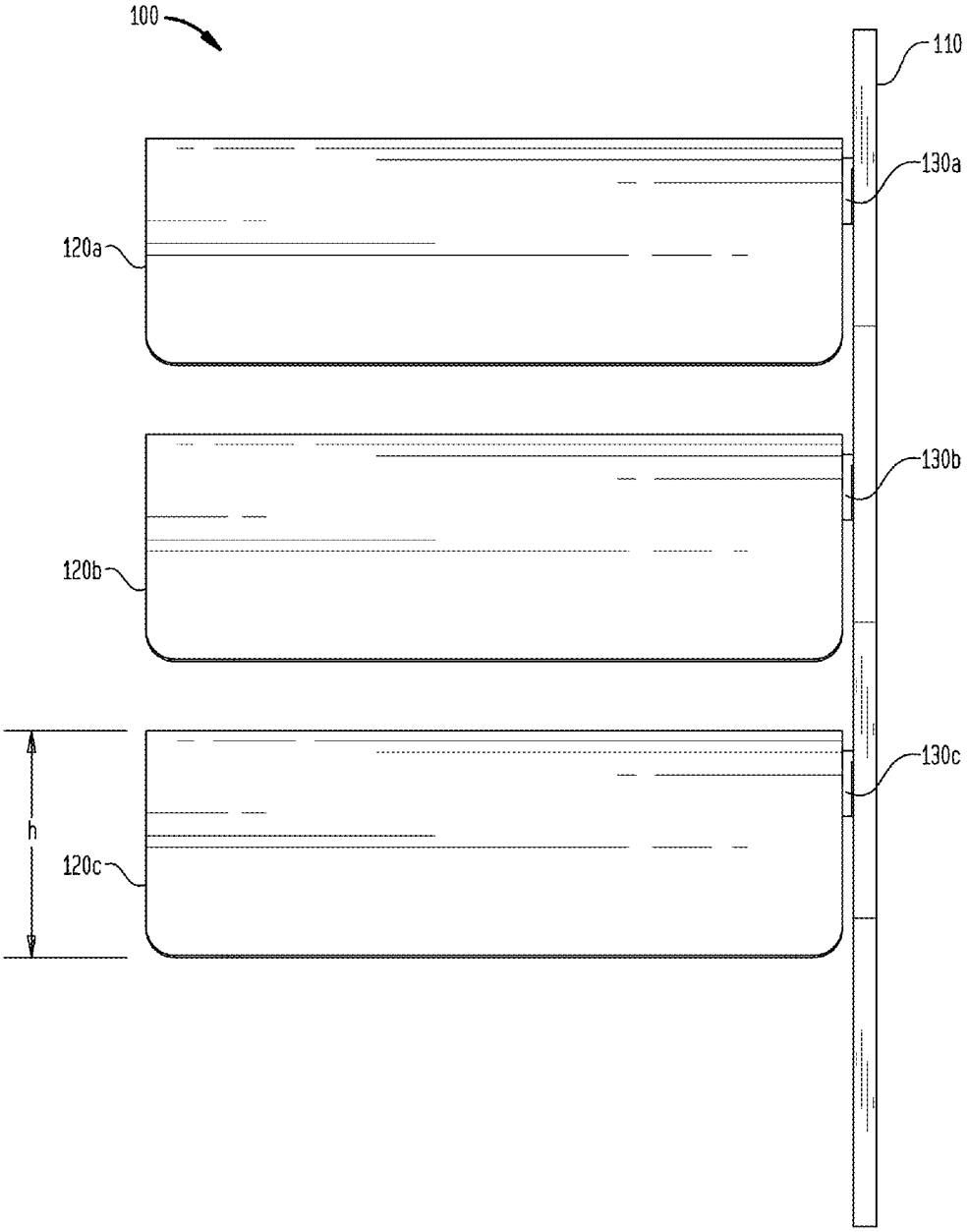
FIG. 5 is a right side elevational view of the embodiment shown in FIG. 1.

The dimensions of the shelf are variable. However, there is a defined relationship of depth to width to height. The depth as measured between edges 122*b*, 122*d* may be twice the width which is the horizontal distance measured between edges 122*a*, 122*c*, and three times the height which is the vertical height of the shelf as measured from the apex to and including the end portions (line "h" in FIG. 5). An exemplary range of dimensions of the shelf is a depth of 22 to 24 inches, a width of 11 to 12 inches and a height of 7 to 8 inches. The depth of the shelf 18 may range from 12 to 28 inches. The width of the shelf 18 may range approximately from 6 to 14 inches. The height of the shelf may range approximately from 4 to 9 inches.

The material used for the shelf 121 may be composed of a rigid or semi-rigid material such as plastic, wood, or a metal. It is contemplated that the surface has minimal flex when multiple items of garment on placed on the shelf assembly 120. However, the shelf 121 is to retain its shape with minimal distortion. The shelf 121 may have a plurality of apertures 142 of either the same or varying sizes or shapes (see FIG. 14). The plurality of apertures 142 allow passage of air through the shelf assemblies and promote drying of the fabric of a single garment 800 and maintains the freshness of the bottom shirt or other garment 800 during storage. Alternatively, non-perforated material may be utilized.

As shown in FIGS. 1, 3 and 4, the upper surface 144 of the shelf 121 may include a friction material 128 exhibiting a high coefficient of friction characteristic. One type of friction material 128 may be in the nature of hook-like portions of a conventional hook-and-loop fastener system in the area of the central portion 123 of the shelf. Alternatively, materials such as textured rubber and more specifically textured neoprene rubber also referred to as anti-slip or non-slip rubber may be used for the friction material 128. The textured rubber may have a thickness of 0.032 inch to 0.125 inch. Alternatively, a portion of the surface material may be coated with a high coefficient of friction substance. These types of friction material 128 have been described by way of example only and other types of friction or roughened material, which are conventional in nature, may be utilized. The friction material 128 is preferably formed as a strip or panel and is attached to the upper surface 144 using a conventional attachment method such as an adhesive. The orientation of the friction material 128 is such that is positioned along the depth of the shelf, i.e. front to back of the shelf. However, the friction material 128 may also be orientated along the width of the shelf.

The upper surface of the flanking wing portions 124*a, b* and end portions 125*a, b* of shelf 121 may have a low friction coefficient characteristic, allowing portions of the first garment on the shelf not in contact with the friction material 128 to slide/flow along the upper surface 144 without restriction.

Figure 7:
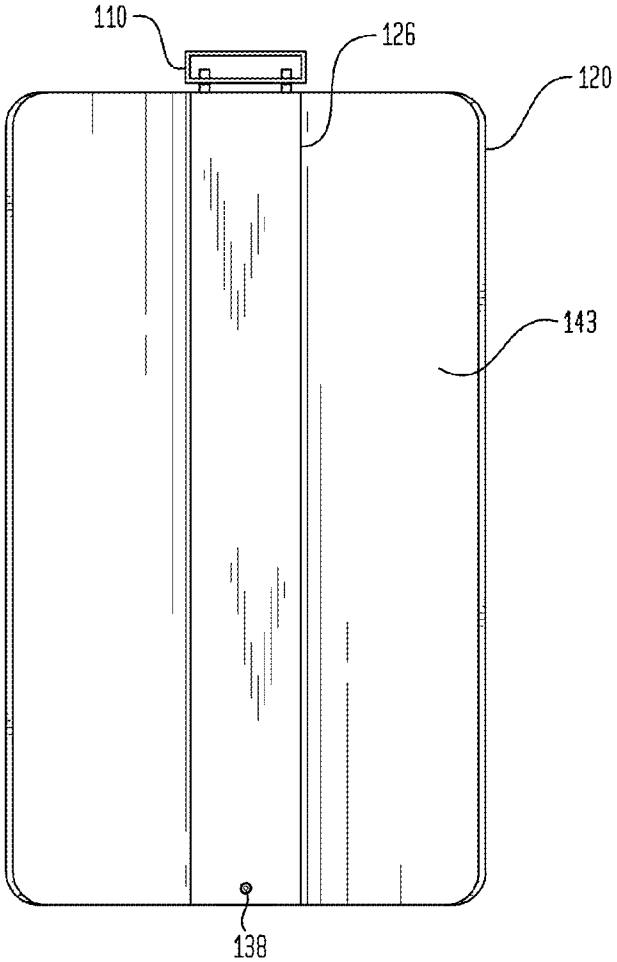
FIG. 7 is a bottom elevational view focusing on a shelf according to the embodiment shown in FIG. 1.

Each of the shelf assemblies 120*a-c* may have a centrally disposed channel 126*a-c* which fits over support bracket 130*a-c* as shown in FIG. 2. The channel 126 is attached to the lower surface 143 (FIG. 7) or to frame 141, if the shelf assembly includes a frame. The channel 126 may be secured to the lower surface 143 of the shelf 121 or frame 141 by means of glue, screws riveting, or other well-known means which do not impact or affect the upper surface 144 such that any fastening means do not protrude through the upper surface 144 of shelf 121 (FIG. 6) potentially snagging a garment placed on the shelf.

Figure 9:
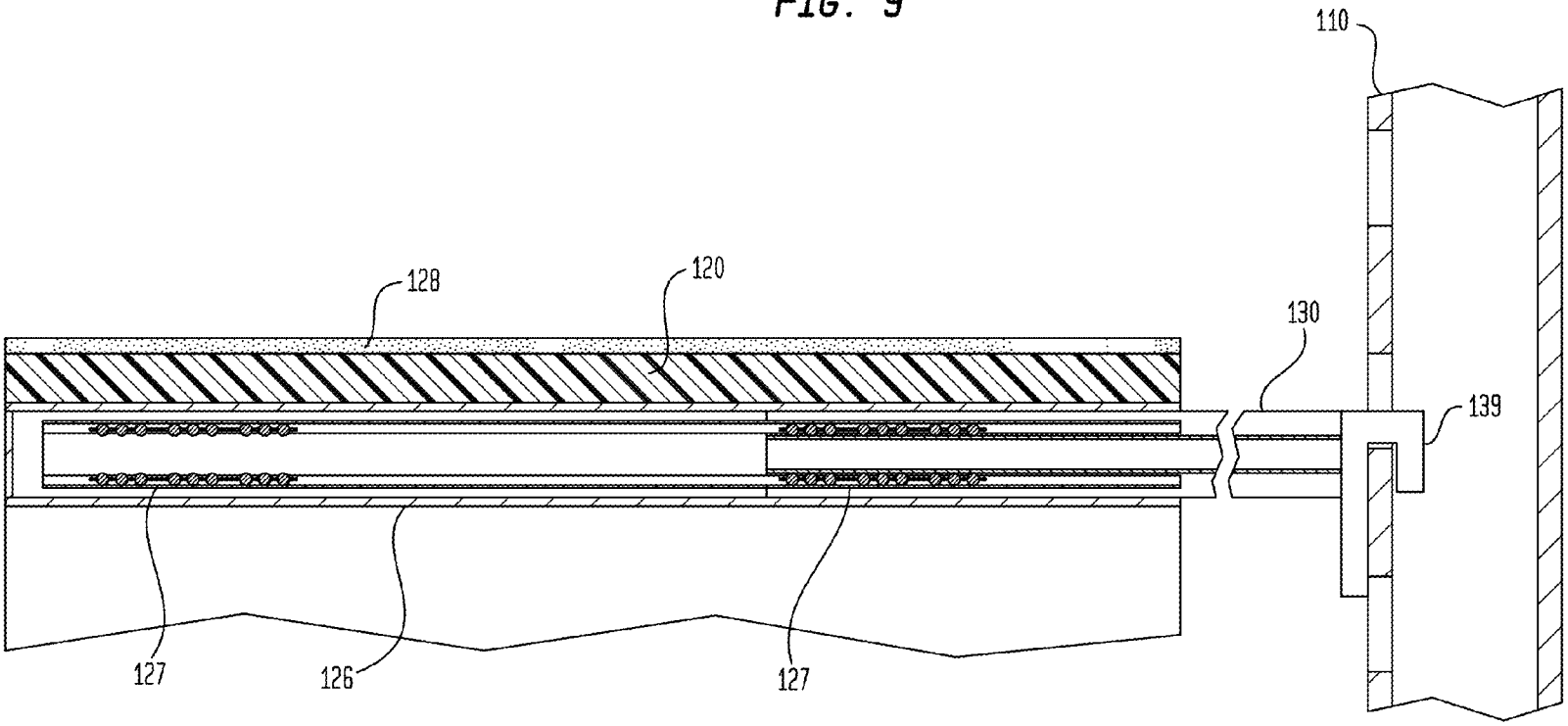
FIG. 9 is a side section view of the shelf extended out of the embodiment shown in FIG. 2.

The channel 126 may be rectangular HSS having matching ball bearing rails 127 attached to the inside side surfaces of the rectangular HSS (see FIG. 9). The ball bearing rails 127 are spaced apart such that the pair of horizontally projecting rails 134 of the support bracket 130 fits in between the ball bearing rails and the channel 126 is capable of gliding along the pair of horizontally projecting rails 134 of the support bracket 130.

Figure 8:
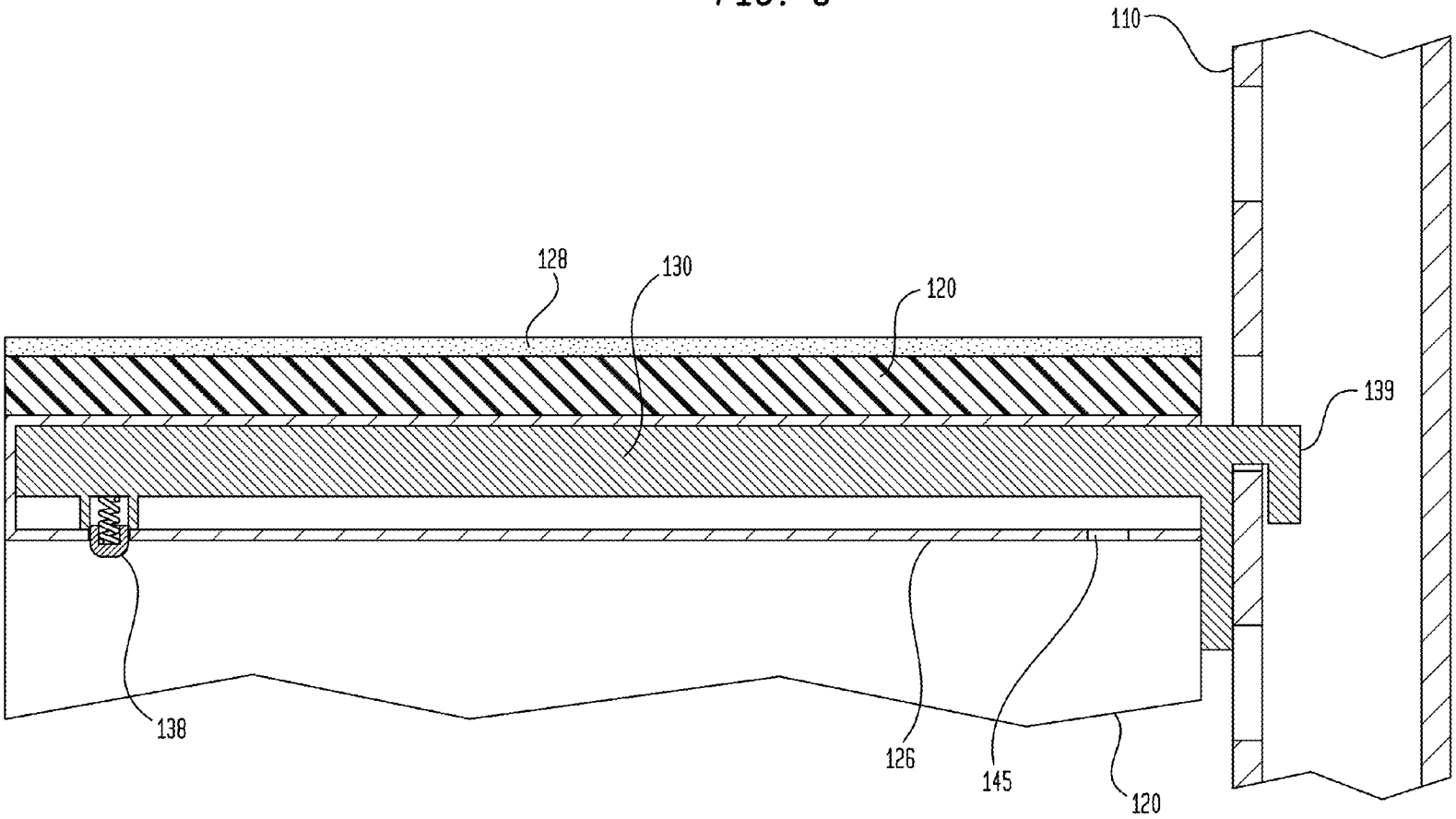
FIG. 8 is a side sectional view of the support bracket and shelf of the embodiment shown in FIG. 2.

The lower surface of the channel 126 may have one or more holes 145 to engage the pin locking mechanism 138 (see FIG. 8) of the support bracket 130. As shelf assembly 120 is pulled away from the support member 110, pin locking mechanism 138 engages with one of the holes 145 in the channel 126, ensuring the shelf assembly 120 cannot be inadvertently pulled too far away from the support member 110 such that it is no longer supported by the support bracket 130.

The details of construction of the support bracket 130 and the channel 126 above have been described by way of illustration only and it is clear that a range of slide mechanisms such as one side of a conventional slide mechanisms incorporated on desk drawers may be utilized to allow each of the shelf assemblies 120*a-c* to slide individually as shown by arrows 3, 4 in FIG. 10, providing convenient access for the user. As with many forms of slide mechanisms, they incorporate a stop mechanism, either the same or different than the pin locking mechanism 138, to prevent a user from pulling the shelf too far out from the support member 110.

The shelf assembly 120 may include a handle 140 (FIG. 12), preferably an integrally formed handle. The handle 140 may be integrally formed with a frame 141, if present, or comprise a "lip" on the shelf 121 at or near edge 122*d* in embodiments where no frame is present. The handle 140 assists a user to move shelf 120 in the directions shown by the arrows 3, 4 in FIG. 10.

Figure 18:
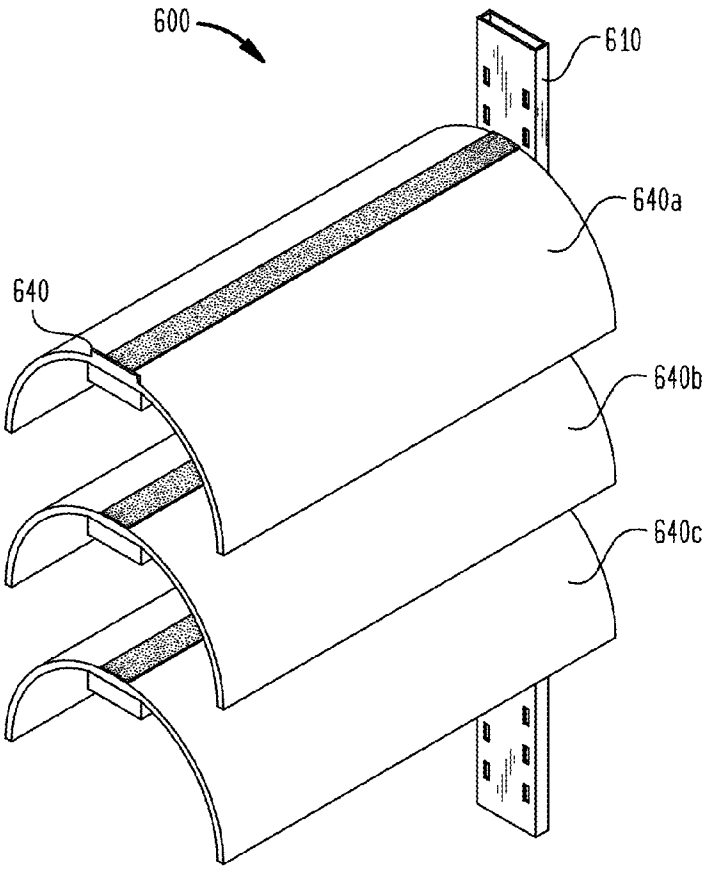
FIG. 18 is a perspective view of still another embodiment of the invention.
Figure 20:
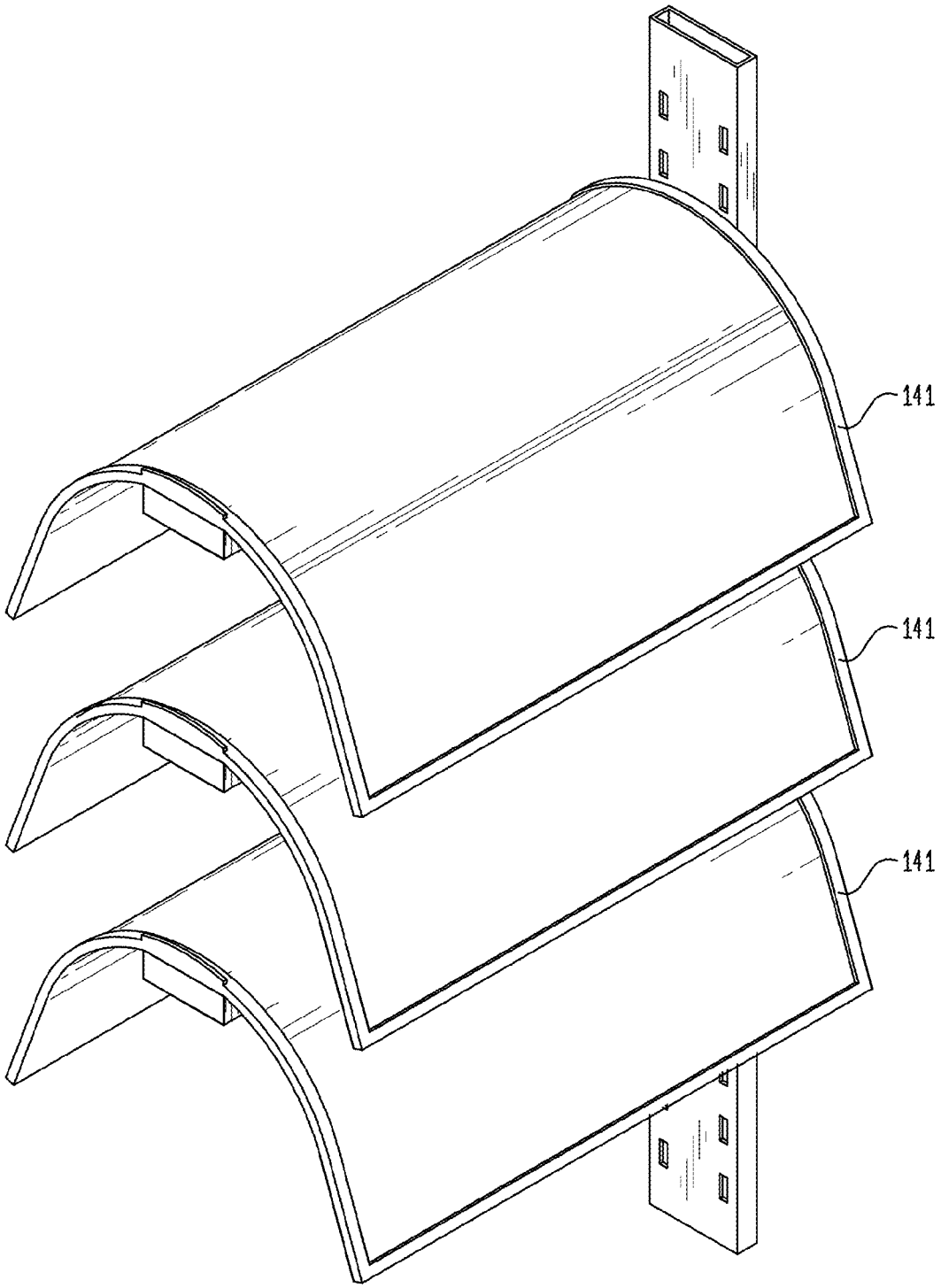
FIG. 20 is a perspective view of yet another embodiment of the invention.

In an embodiment where the shelf includes a frame shown in FIG. 20, the frame 141 may be composed of rigid or semi-rigid material such as plastic. Other materials, such as various metals, wood, etc. are contemplated. The frame in the case of a plastic frame may be molded. As shown in FIG. 18, the frame is generally rectangular in shape.

The edges 122*a-d* of the surface 121 may be molded into the frame 141. Alternatively, the edges 122*a-d* of the surface 121 may be attached to the top of the frame. The edges 122*a-d* may be secured to the frame 141 using an adhesive material to adhere the surface material to the frame 141. The shelf 120 may be flat or have a downward curve.

Figure 17:
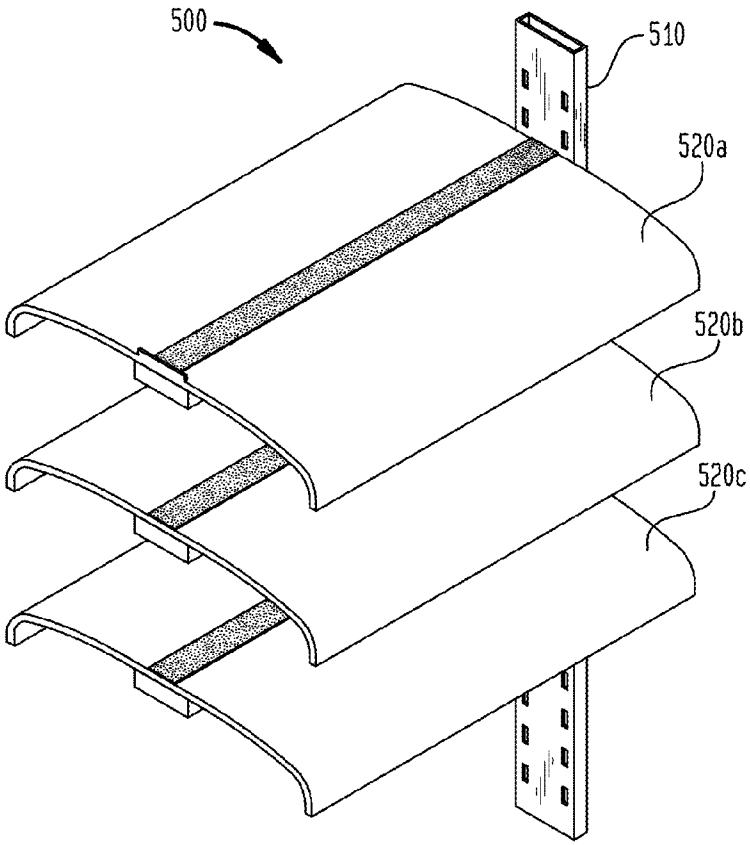
FIG. 17 is a perspective view of still another embodiment of the invention.

As shown in FIGS. 1, 2, 4, 10, and 12, the shelf 121 of the shelf assembly 120 is curved in an elliptical arc. Circular arcs of varying sizes are also contemplated, as shown in FIGS. 17 and 18, as are other shapes. The curvature of the shelf 120 may be defined as being curved from side to side (convex downward). As previously noted, the shelf 121 comprises a central portion 123, flanking wing portions 124*a, b* and end portions 125*a, b*. The central portion 123 is raised relative to the flanking wing portions 124*a, b* at the apex of the curve. This arrangement facilitates the proper draping of the shirt or other garment 800 and helps with the elimination of creases without the need for folding the garment. The central portion 123 has a larger radius (less pronounced curve) as compared to the flanking wing portions 124*a, b*, each of which have a relatively more pronounced curvature (smaller radius). The end portions 125*a, b* are "flared out" and are linear having complimentary angles of about 70 degrees to the horizontal. On a circular shaped shelf assembly, the end portions 125*a, b* are linear and vertically or near vertically oriented. It is contemplated that the curvature of the central portion 123 and the flanking wing portions 124*a, b* may vary in various embodiments.

The curvature of the elliptical shelf embodiment may be greater (smaller radius) than that of a circular curved shelf embodiment (described below) allowing garments placed on the shelf assembly 120 to hang more vertically, causing a greater gravitational force to act on garments thereby reducing creases already present and reducing the likelihood of forming creases.

The surfaces of the central portion 123, the flanking wing portions 124*a, b* and the end portions 125*a, b* are blended. These surface areas form a smooth uninterrupted surface of the shelves 120*a-c* which reduces the likelihood of forming creases in a shirt or other garment when placed on the shelf.

The elliptical shaped shelves have a benefit that the shelves can be located closer to each other in a vertical orientation of the Adjustable Storage System than when the shelves have a circular shape and are of the same size.

As stated previously, the arc of the shelf may be circular in nature as opposed to elliptical. FIGS. 17 and 18 depict various circular shaped shelves, having different radiuses. The radius of the curvature may vary from a large radius (gentle curve), shelf assemblies 520*a-c* (FIG. 17) to small (more pronounced) radius, shelf assemblies 620*a-c* (FIG. 18).

Figure 16:
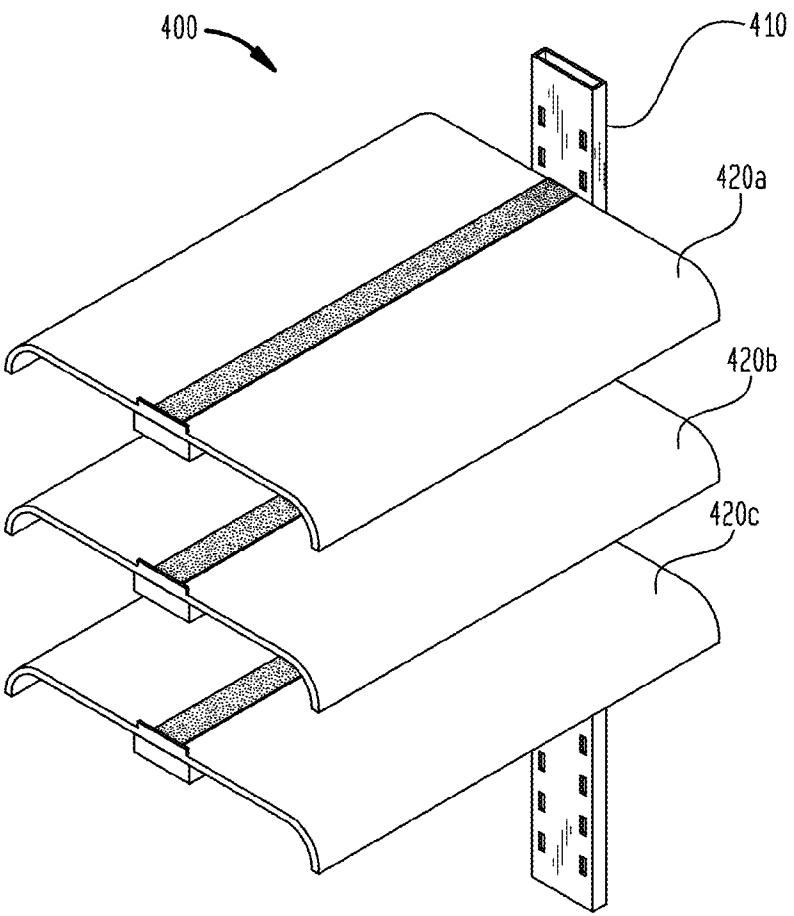
FIG. 16 is a perspective view of still another embodiment of the invention.
Figure 15:
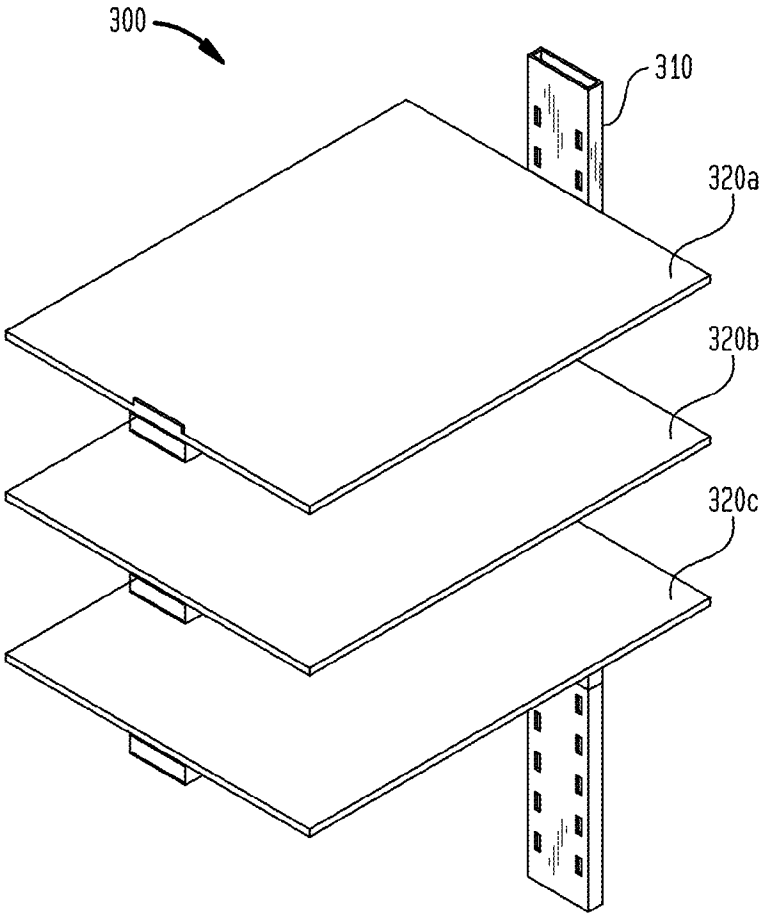
FIG. 15 is a perspective view of yet another embodiment of the invention.

As stated previously, the shelves assemblies 120 may also be flat (FIGS. 15 and 16) without any curvature. It is contemplated that a flat shelf assembly 320*a-c* may have the same size as that of a curved shelf 120*a-c*. The structure of a flat shelf assembly 320 may have the same structural components as that of a curved shelf such as describe with regards to shelf assembly 120. That is, a flat shelf assembly will have a central portion and flanking wing portions. Optionally, the flat shelf assembly may include vertically or near vertically oriented end portions. FIG. 16 depicts a flat shelf assembly with end portions and FIG. 15 depicts flat shelf assemblies without end portions. All sections of the shelf form a smooth uninterrupted surface of the shelf which reduces the likelihood of forming creases in a shirt or other garment when placed on the shelf.

FIG. 13 depicts an embodiment of the shelf assembly 120 comprising multiple parts capable of being assembled. An advantage of this embodiment of the shelf assembly is that packaging and storage is more efficient because the shelf assembly when disassembled takes less space than when assembled. As shown in FIG. 13, the shelf assembly 120 comprises complimentary matching shelf wings 121*a*, 121*b*, a channel 126, friction material 128 and mounting screws 129. The mounting screws 129 may be substituted with other conventional fastening devices. The mounting screws 129 secure the complimentary matching shelf wings 121*a, b* to the channel 126 by holes 146 and 148*a, b*. The embodiment depicts 12 holes each of 146, 148. However, more or less holes are contemplated. If mounting screws 129 are employed, the screws may be flat head or countersunk screws, allowing the screw head to sink into the surface of the matching shelf wings 121*a, b* such that the head of the screw is flush with the surface of the matching shelf wings 121*a, b*. With this configuration, a garment placed on the shelf will not snag or catch on the screw head, if no friction material is used.

When the complimentary, matching shelf wings 121*a, b* are secured to the channel 126, connecting surfaces 147*a* and 147*b* abut with each other forming a seamless connection. As depicted, the connecting surfaces 147*a, b* may be smooth, flat surfaces. It is contemplated that other surface shapes, such as tongue and groove, may be employed on connecting surfaces 147*a, b*. Other surface configurations for the connecting surfaces 147*a, b* are contemplated, allowing the matching shelf wings 121*a, b* to "snap" together in a semi-permanent fashion. Friction material 128, if used, is secured to the assembled shelf wings 121*a, b* over the screws 129 ensuring any garment placed on the shelf assembly is not caught or snag on a screw head. The friction material 128 may include an adhesive strip or an adhesive layer on one side to affix to the matching shelf wings 121 *a, b*.

The matching shelf wings 121*a, b* when assembled together may form an elliptical or circular arc similar to those discussed above. The arc may be of varying radiuses from large (less pronounce curve) to a small radius (more pronounced curve). The matching shelf wings 121*a, b* will comprise the three sections, central portion, flanking wing portions, and end portions, described previously. The multi-part shelf assembly has the same features of the unitary shelf assembly described above, only that it is possible to assemble and disassemble. A disassembled shelf assembly allows for more efficient storage and packaging, i.e., taking less space than an assembled or unitary shelf assembly.

Figure 12:
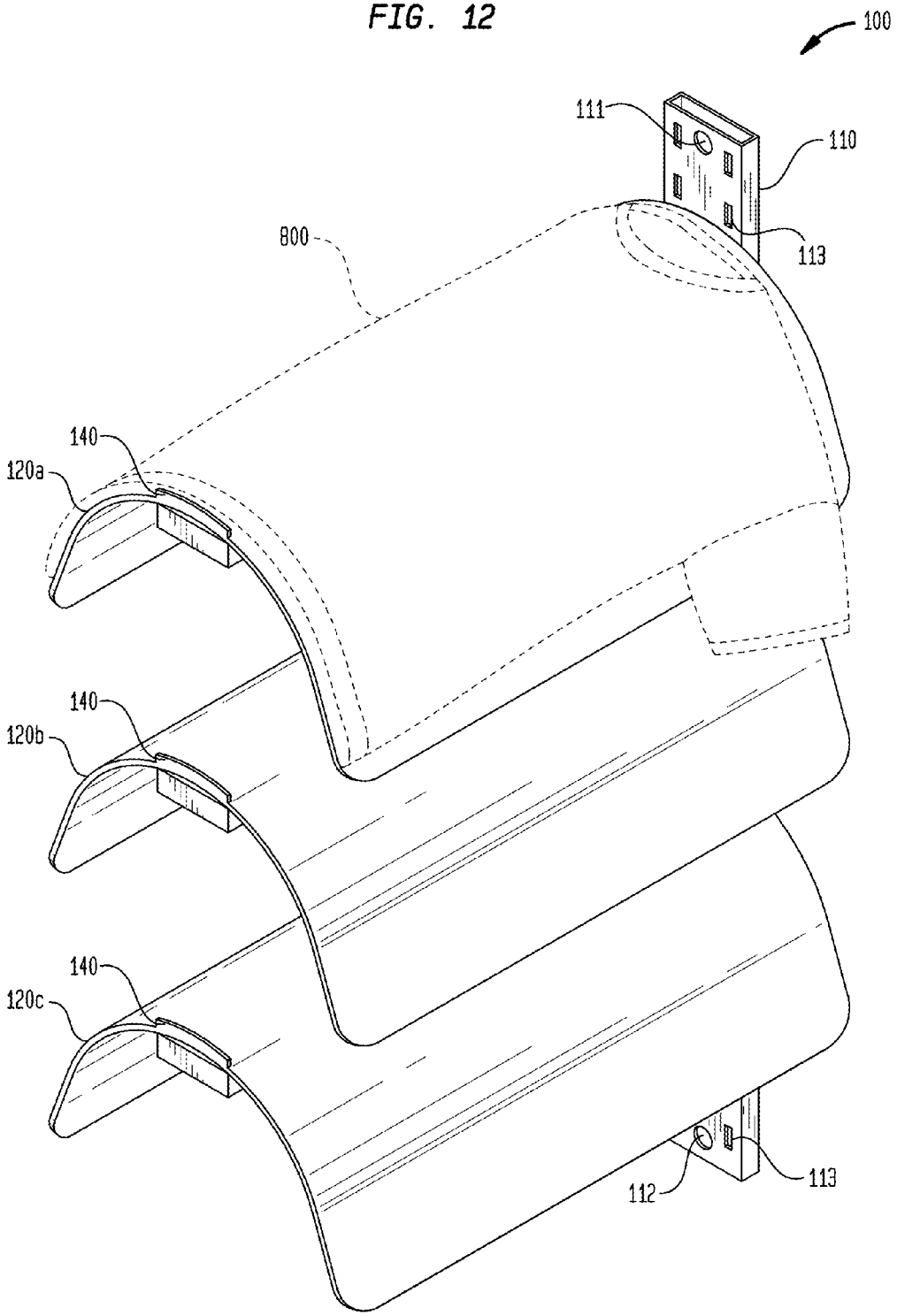
FIG. 12 is a perspective view showing a garment placed on a shelf of the embodiment shown in FIG. 1.

The method of storing clothing is illustrated in FIG. 12. A shelf is selected for storing a garment. The selected shelf is pulled outward along support bracket 130 acting as a rail. A garment 800 such as a sweater or a golf shirt or a t-shirt is draped over the shelf 120 as is shown in FIG. 12. The area or strip of friction material 128 provides a relatively high friction interface between the garment 800 and the shelf 120 and prevents the garment 800 from sliding off the shelf 120. Arm portions of the garment 800 may be draped off the edge of the shelf. One or more garments may be stored on each of the shelves. It is contemplated that 5 to 10 or more garments may be stored on a single shelf.

An alternative method of storing clothing, especially in a commercial retail environment, is to have the shelf 120 in a storage or back room away from customers where merchandise is placed on the shelf in a manner similar to that described above and which is then moved into the retail portion of a store and mounted on a support bracket 130. This eliminates any unpacking of merchandise from boxes in the showroom and having a retail clerk fold and place the garments on a traditional shelf or display unit in the presence of customers.

The force of gravity acting upon the garment 800 and the weight of the shirts lying on each other in combination with the special shape of the shelf, as described, have the following beneficial effect. The force of gravity acting upon the garment 800 urges the garment 800 into contact with the friction material 128. The friction material then prevents sliding of the garment 800 from its position on the shelf. The arm portions of the garment 800 which are draped or hung alongside edges of the shelf 120 provide a gentle downward tugging force. These forces, gently stretching garment 800, help to reduce or eliminate and prevent formation of creases in the garment 800 without folding and avoids forming creases. The gently curved central portion 123 of the shelf 121 allows the fabric of the garment 800 to move slightly in the outward direction. The flanking wing portions 124*a, b* of the shelf 121 help prevent the formation of creases in the garment 84 and reduce creases which may have been formed during a washing or cleaning process. For the embodiments depicted in FIGS. 12 and 16, the vertical or nearly vertical end portions 125*a, b*, of the shelf assemblies 120 allow the portions of the garment 800 to hang freely with little or no contact between the shelves and the garment thereby avoiding a crease where garment hangs over the shelf and increasing vertical gravitational pull on the garment. This enhances the elimination of creases.

It should be understood that various changes, substitutions, additions and alterations can be made by one skilled in the art without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure herein, processes, machines, manufacture, composition of matter, means, methods, or steps, presently existing or later to be developed that perform substantially the same function or achieve substantially the same result as the corresponding embodiments described herein may be utilized according to the present invention.

What is claimed is:

1. An adjustable storage system for clothing comprising:

a support member;

a plurality of support brackets adjustably connected to said support member;

a plurality of shelves, with each of said shelves disposed in a generally horizontal orientation and mounted respectfully on one of each of said plurality of support brackets, each of said shelves comprises a surface having a central portion and flanking wing portions with said central portion raised relative to said flanking wing portions forming a curved arc shape, the depth of each of said shelves exceeds the width of each of said shelves so that each of said shelves is configured to receive a garment laid horizontally on said surface, the surface of each of said shelves further comprises linear extensions that extend from the ends of the flanking wing portions at an angle to the horizontal such that said curved arc shape of said surface has a variable radius of curvature; and wherein the central portion, the flanking wing portions, and the linear extensions of each of said shelves are blended so that the entire surface of each of said shelves is smooth and uninterrupted and is configured to reduce formation of creases in a shirt or other garment when placed on each of said shelves.

2. The adjustable storage system for clothing according to claim 1, wherein the central portion and the flanking wing portions of said shelves are curved in a convex shape, and wherein said central portion leads to said pair of flanking wing portions.

3. A storage system for clothing comprising:

a support member;

one or more support brackets connected to said support member;

one or more shelves, wherein each of the one or more shelves is respectively mounted on one of the one or more support brackets, each of the one or more shelves comprises a surface having a central portion and flanking wing portions, wherein the central portion is raised relative to the flanking wing portions forming a curved arc shape, the depth of each of the one or more shelves exceeds the width of each of the one or more shelves so that each of the one or more shelves is configured to receive a garment laid horizontally on said surface, the surface of each of said one or more shelves further comprises linear extensions that extend from the ends of flanking wing portions at an angle to the horizontal such that said curved arc shape of said surface has a variable radius of curvature; and wherein the central portion, the flanking wing portions, and the linear extensions of each of said one or more shelves are blended so that the entire surface of each of said one or more shelves is smooth and uninterrupted and is configured to reduce formation of creases in a shirt or other garment when placed on each of said one or more shelves.

4. The storage system for clothing according to claim 3, wherein said support member comprises a vertical support member.

5. The storage system for clothing according to claim 3, wherein the central portion and the flanking wing portions of said one or more shelves are curved in a convex shape, and wherein said central portion leads to said pair of flanking wing portions.

6. The storage system for clothing according to claim 5, wherein the curve of said central portion and flanking wing portions is elliptical in shape and the curve of said central portion has a larger radius than the curve of said flanking wing portions.

7. The storage system for clothing according to claim 3, wherein said one or more shelves are each slidably mounted on a respective one of said of one or more support brackets.

8. The storage system for clothing according to claim 3, further comprising a portion of friction material with said portion of friction material disposed on top of the surface of each of said one or more shelves.

9. The storage system for clothing according to claim 8, wherein said portion of friction material is centrally disposed on said central portion of the surface of each of said one or more shelves.

10. The storage system for clothing according to claim 9, wherein each of said one or more shelves has a generally rectangular configuration.

11. The storage system for clothing according to claim 3, wherein said surface is convex shaped.

12. The storage system for clothing according to claim 5, wherein the curve of said central portion and flanking wing portions is circular in shape and the curve of said central portion has a greater radius than the curve of said flanking wing portions.

13. The storage system for clothing according to claim 3, wherein the depth of each of said one or more shelves is approximately twice the width of each of said one or more shelves.

14. The adjustable storage system for clothing according to claim 1, wherein the depth of each of said shelves is approximately twice the width of each of said shelves.

15. A storage system for clothing comprising:

a support member;

one or more support brackets connected to said support member;

one or more shelves, wherein each of the one or more shelves is respectively mounted on one of the one or more support brackets, each of the one or more shelves comprises a surface having a central portion and flanking wing portions, wherein the central portion is raised relative to the flanking wing portions forming a curved arc shape, the depth of each of the one or more shelves exceeds the width of each of the one or more shelves so that each of the one or more shelves is configured to receive a garment laid horizontally on said surface, each of the one or more shelves comprises two separate halves fastened to a respective said one or more support brackets to form said central portion and flanking wing portions; and wherein the central portion and flanking wing portions of each of said one or more shelves are blended so that the entire surface of each of said one or more shelves is smooth and uninterrupted and is configured to reduce formation of creases in a shirt or other garment when placed on each of said one or more shelves.

* * * * *